US008207805B2

(12) United States Patent
Wild et al.

(10) Patent No.: US 8,207,805 B2
(45) Date of Patent: Jun. 26, 2012

(54) PUSH-BUTTON

(75) Inventors: Jörg Wild, Heilbronn (DE); Jŏrg Reisinger, Gemmrigheim (DE); Oliver Höger, Backnang (DE); Nikolaus Rades, Heilbronn (DE)

(73) Assignee: W. Gessmann GmbH, Leingarten (DE)

( * ) Notice: Subject to any disclaimer, the term of this patent is extended or adjusted under 35 U.S.C. 154(b) by 499 days.

(21) Appl. No.: 12/381,864

(22) Filed: Mar. 17, 2009

(65) Prior Publication Data

US 2010/0236911 A1 Sep. 23, 2010

(51) Int. Cl.
*H01H 9/00* (2006.01)
*H01H 3/12* (2006.01)
*H01H 13/70* (2006.01)

(52) U.S. Cl. ..... 335/207; 335/177; 335/205; 335/206; 200/341; 200/345

(58) Field of Classification Search ..... 335/151–153, 335/167–176, 177–184, 205–207, 302; 324/207.4, 324/207.2, 207.22, 207.21, 207.24, 207.25, 324/235, 251, 252; 200/341–345; 338/32 H, 338/12

See application file for complete search history.

(56) References Cited

U.S. PATENT DOCUMENTS

| | | | | |
|---|---|---|---|---|
| 3,167,624 | A * | 1/1965 | Jones, Jr. | 335/205 |
| 3,414,853 | A * | 12/1968 | Motis | 335/207 |
| 3,855,439 | A * | 12/1974 | Hermann | 200/524 |
| 3,873,957 | A * | 3/1975 | Wurscher et al. | 338/32 H |
| 3,934,215 | A * | 1/1976 | Rich et al. | 335/207 |
| 3,942,145 | A * | 3/1976 | Sobczak | 335/188 |
| 6,097,272 | A * | 8/2000 | Grover et al. | 335/207 |
| 6,867,680 | B1 | 3/2005 | Kulle | |
| 6,965,085 | B1 * | 11/2005 | Orrico et al. | 200/314 |
| 2005/0034966 | A1 * | 2/2005 | Krebs et al. | 200/341 |
| 2007/0051608 | A1 * | 3/2007 | Pedersen et al. | 200/341 |
| 2007/0219409 | A1 * | 9/2007 | Shimizu et al. | 600/112 |
| 2007/0227870 | A1 * | 10/2007 | Parnell | 200/341 |
| 2008/0284549 | A1 * | 11/2008 | Bedell | 335/170 |

FOREIGN PATENT DOCUMENTS

| | | | |
|---|---|---|---|
| DE | 37 13 775 | C2 | 11/1988 |
| DE | 42 16 454 | A1 | 12/1992 |
| DE | 197 30 297 | A1 | 1/1999 |

* cited by examiner

*Primary Examiner* — Mohamad Musleh

(74) *Attorney, Agent, or Firm* — Walter A. Hackler

(57) ABSTRACT

The invention relates to a push-button (5) having a housing (10), with which there are associated at least a first actuation member (6) which triggers a haptic control signal and one or more permanent magnet(s) (3) which can be guided past at least a second actuation member (2) which triggers a switching operation, and there is associated with the first actuation member (6), which triggers a haptic response, a control element having a first progressive or degressive control face portion (6.1) and at least a second adjoining control face portion (6.2) which behaves in an inverse manner and along which the actuation member is guided.

19 Claims, 4 Drawing Sheets

PUSH-BUTTON

The present invention relates to a push-button having a housing, with which there are associated at least a first actuation member which triggers a haptic control signal and one or more permanent magnet(s) which can be guided past at least a second actuation member which triggers a switching operation.

There is already known (U.S. Pat. No. 6,867,680B1) a push-button which has a tappet which is supported in a housing so as to be movable counter to the effect of a restoring spring and with which there are associated at least one haptically acting control signal, a haptic triggering actuation element in the form of a ball and two permanent magnets which trigger at least one switching pulse at a second actuating member or a Hall sensor, which triggers a switching operation when the tappet with its magnets is moved past the Hall sensor. This solution does not have a defined, selectively influencable haptic or acoustic response.

The haptic action of the previously known solutions seldom approaches an ideal force/travel characteristic. Non-optimum operating reliability produces an impression of quality which is inferior. Furthermore, the Hall effect push-button is not configured so as to be redundant and is consequently not protected sufficiently from failure. If a spring breakage occurs in this switch, the push-button is not switched off and the machine which can be actuated by means of the switch is placed in an uncontrollable state. Should relatively large power transitions be produced, the ball can be used as a switching element only to a limited degree because the ball radius has to be relatively small in order to produce a steeply descending side, whereby only small travel paths can again be produced.

Push-buttons having conventional switching contacts always have the problem that the response is coupled to the switching operation. That is to say, both the haptic response and the acoustic response are dependent on an electromechanical switching element. The haptic action of the above-mentioned push-button can be changed only if the switching element is reconfigured, which again results in a high level of development complexity and high costs for tool construction.

SUMMARY OF THE INVENTION

The problem addressed by the invention is to construct and arrange a push-button in such a manner that a defined and/or influencable feedback in the form of a response is transmitted to the operator.

The problem is solved according to the invention in that there is associated with the first actuation member, which triggers a haptic response, a control element having a first progressive or degressive control face portion and at least a second adjoining control face portion which behaves in an inverse manner and along which the actuation member is guided. The resultant time/travel characteristic can be of variable size. By means of the first ascending control face portion and at least a second descending control face portion, a haptic response which can be perceived very well is transmitted to the operator even when the push-button is used in a device which is subject to powerful vibrations. The perception of the response can further be optimised by the form of the time/travel characteristic.

To this end, it is advantageous for a resilient actuation element and control face portions which extend substantially in the movement direction of the push-button to be associated with the first actuation member. In accordance with desired provisions or the previously configured force/travel characteristic, the control face portions can accordingly be modified in terms of the length and/or inclination thereof. To that end, the contour module simply needs to be replaced with a modified outer contour. The retrofitting of the switch is very simple to carry out. The storage costs of such push-buttons can further be reduced because only corresponding modules of the switch have to be produced beforehand and the switches can then be assembled in accordance with customer requirements.

It is also advantageous for the first control face portion, which covers a large travel path, to extend in a substantially linearly ascending manner; the descending control face portion, which covers a small travel path, is adjacent thereto and at least one additional ascending third control face portion which covers a large travel path is adjacent thereto.

It is also advantageous for the first actuation member which triggers a haptic control signal, the second actuation member which triggers a switching operation and/or a third actuation member (acoustics) which triggers a sound pulse to be associated with the push-button.

The control face portions can be travelled in a very perceptible manner by means of the resilient actuation element, with the continuously ascending actuation pressure of the operator transmitting a very perceptible impression concerning the actuation path and the switching function. That push-button having an independently adjustable haptic action and acoustics and having a decoupled electrical switching operation can be advantageously used in handles of composite drives for industrial vehicles, for example, diggers, crawler type vehicles and wheel loaders. During actuation, the operator experiences a clear signal, the operator being able to say with certainty whether he has carried out a switching operation or not. The response to the operator is carried out via the haptic and acoustic sense. Since the haptic and acoustic response are independent of each other, they can also be very readily changed when other operating conditions arise. The haptic action of the push-button according to the invention can, as already mentioned, be modified without any complexity because the first actuation member which has different characteristics can readily be replaced, which again results in little development complexity and low costs for tool construction.

To that end, it is advantageous for the first actuation member which triggers a haptic control signal and the other actuation members to be decoupled from each other in terms of effect.

In another construction of the invention, it is advantageous for the switching operation which is triggered by one or more actuation member(s) to be carried out by means of Hall sensors, light barriers, mechanical switching contacts or capacitive or inductive sensors.

It is particularly advantageous for the first actuation member to be in the form of a torsion spring and to be able to be guided along a guide contour which is provided in the housing and which forms the control face portions when the push-button or a push-button actuation element is moved in an axial direction. By means of Hall sensors, or alternatively light barriers, capacitive or inductive sensors, mechanical switching contacts, Reed contacts, it is readily possible to carry out the desired switching operation. A defined haptic and acoustic response provides the operator with the highest possible degree of certainty that the push-button has been actuated and transmits to the operator a very good feeling concerning the switching operation.

The separation of the functions between the electrical switching operation, haptic action and acoustics is newly implemented with the advantageous construction of the push-button. The individual functions can thereby be optimised and varied independently of each other. A clear and defined response is important both for the operational reliability and for a very perceptible impression of the push-button. The functions of the electrical switching operation and haptic and acoustic response can be transmitted to the operator separately from each other owing to the advantageous construction of the push-button. The new type of push-button has a defined haptic response which is based on a previously defined force/travel target characteristic or is derived therefrom in an advantageous manner.

The haptic action can be adapted owing to the mechanics in the push-button in accordance with the desired characteristic. The characteristic is divided into a linear portion and into the force transition. Owing to this division, it is possible for the parameters of the characteristic to be adjusted separately. The linear portion is brought about with a linearly resilient element, such as a compression spring, resilient bar, magnetic field, silicone mat, rubber member. However, the construction of the linear portion can be carried out in both a progressive and a degressive manner. The force transition or tactile feedback is also brought about by a resilient element, such as a torsion spring composed of plastics material having a round head, snap-fit disc, resilient disc or a compression spring having a steel ball, which travels over a defined elongate contour in accordance with the principle of a roller guide. In accordance with the contour, the resilient element is subjected to a change in force which constitutes the force transition or tactile feedback. If the characteristics of the linear portion and the force transition are combined, the desired force/travel target characteristic of the push-button is obtained by addition of the lines.

If a plurality of sensors can be used independently of each other, a plurality of pieces of information concerning the position, operation and magnitude of failure of the switch can be provided. The multiply redundant construction of the sensors increases the reliability and improves the possibilities for evaluation. A higher level of operational reliability is obtained by using the sensor or, if necessary, a plurality of sensors. By means of the sensor, it is readily possible to establish the position of the push-button or the operating state, or a malfunction of the switch.

It is further advantageous for the guide contour provided in the housing to have one or more engagement position(s) which is/are each associated with a switching function.

To that end, it is also advantageous for the push-button to have a tappet, with which there is associated in the lower actuation region a security means against spring breakage which comprises a first abutment which is arranged on the tappet and a stop which is provided on the housing and which is in the movement plane of the abutment.

According to a preferred configuration of the solution according to the invention, there is finally provision for there to be provided, in the lower region of the tappet, a contact or contact switch, against which the tappet can be moved directly or indirectly into abutment in the end position thereof when it has passed the security means against spring breakage which is formed by the abutment and the stop. The contact or contact switch with its contact element is preferably positioned in the movement plane of the tappet.

In conjunction with the construction and arrangement according to the invention, it is advantageous for the abutment of the tappet to have an abutment face which is moved into abutment against an abutment face provided on the first actuation member in the initial position or inactive position of the push-button by means of a restoring spring.

It is further advantageous for the housing to have, in the upper region, a recess for receiving the restoring spring which abuts, on the one hand, the push-button actuation element and, on the other hand, the housing.

It is further advantageous for the torsion spring to be constructed at least partially as a sleeve which is connected, on the one hand, to a cylindrical journal which is securely connected to the push-button actuation element and which has, on the other hand, resilient torsion spring elements.

It is further advantageous for an air gap to be provided between the outer periphery of the push-button actuation element and the inner periphery of the recess.

It is also very advantageous that the restoring force of the spring is greater than the restoring force of the torsion spring. It is thereby ensured that the push-button switch always returns to its initial position when the push-button is released and the safety means against spring breakage is not actuated.

It is also advantageous for the actuation member to have one or more control face portion(s) which extend(s) in an inclined manner at an angle relative to the centre plane of the tappet and which can enclose an angle of between 3° and 30° with the centre axis of the actuation member.

It is further advantageous for an angled control face portion to adjoin the control face portion, with the size of the angle between the two control face portions being able to be between 77° and 130°.

It is also advantageous that the haptically acting first actuation member which is associated with the push-button, the second actuation member which triggers a switching operation and the third actuation member (acoustics) which triggers a sound pulse are adjustable relative to each other. The independent adjustability and capacity for variation of the haptic electrical, acoustic switching points makes the switch usable in a versatile manner. If additional sensors are fitted, the redundancy of the push-button is increased.

It is further advantageous for the first actuation member to be formed by the contour module and the torsion spring and for the actuation member which triggers a haptic control signal to comprise a guide contour provided in the housing and the actuation element which co-operates therewith, which is in the form of a torsion spring and which can be guided along the guide contour of the actuation member by means of the push-button actuation element.

DETAILED DESCRIPTION

Figure 1:
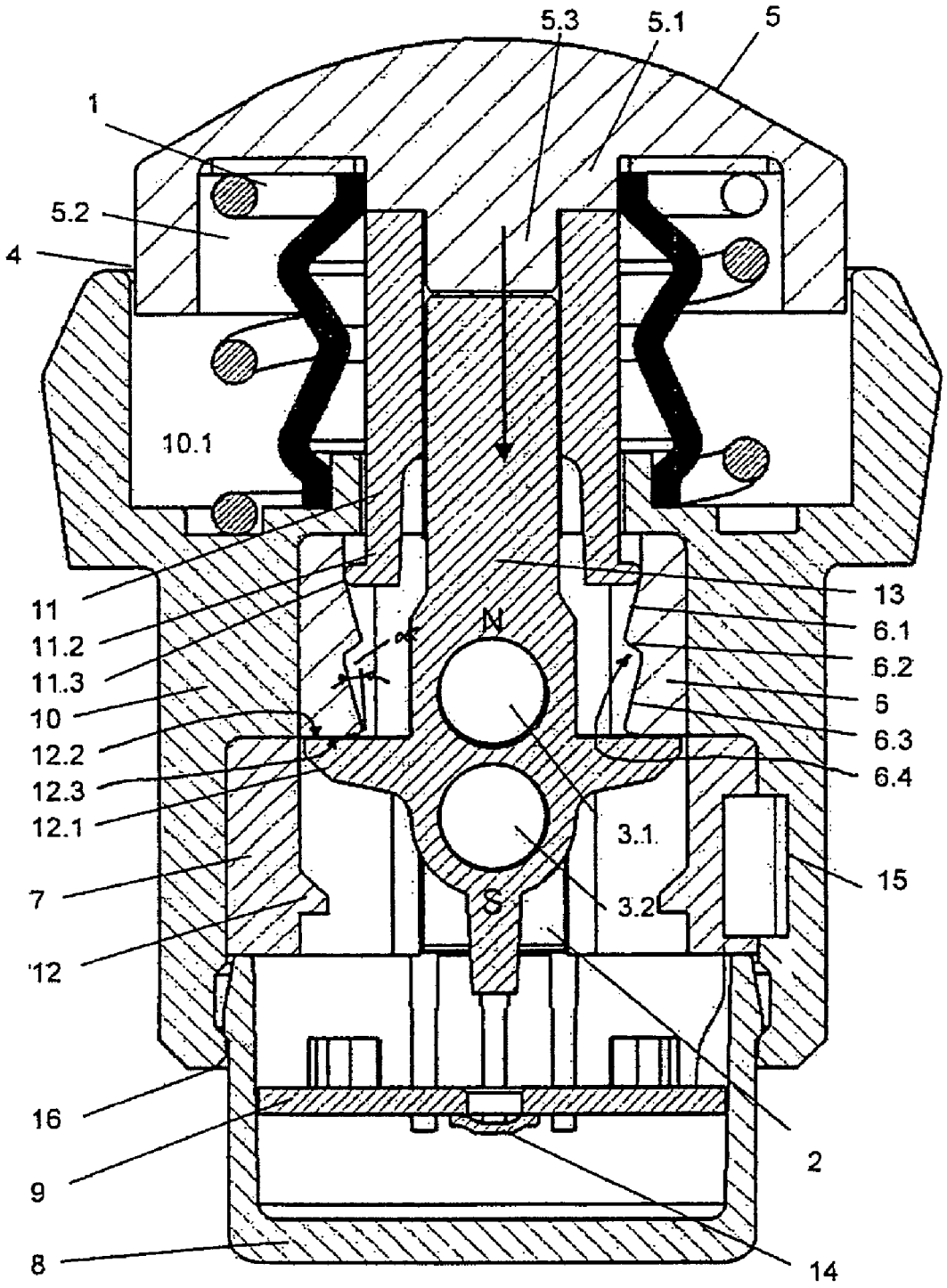
FIG. 1 is a cross-section of a push-button having a housing, with which there are associated at least a first actuation member which triggers a haptic control signal and one or more permanent magnet(s)
Figure 2:
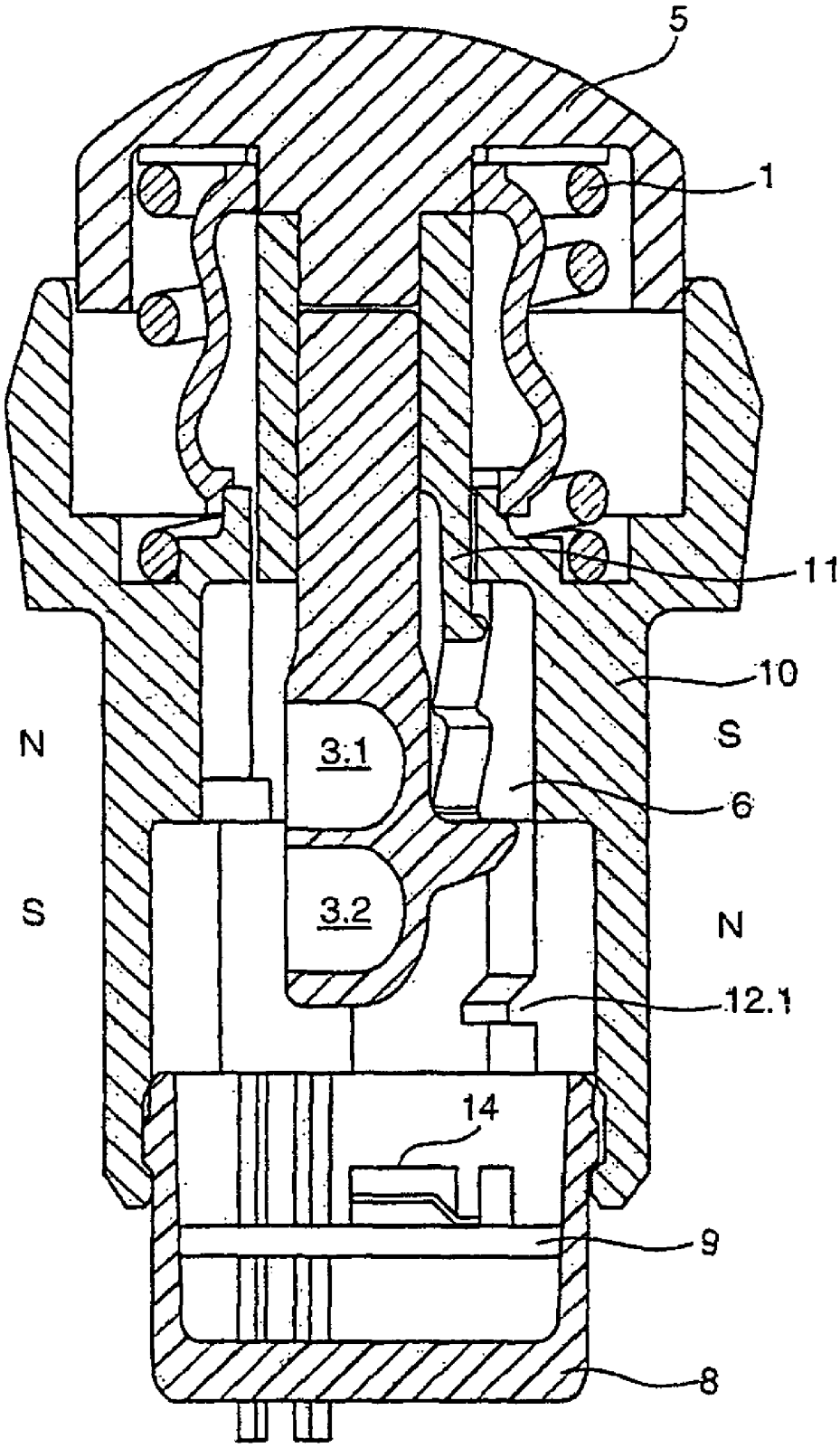
FIG. 2 is a cross-section of a push-button having a housing according to FIG. 1, rotated through 90°.

The drawings illustrate a push-button 5 having a tappet 13, which is supported so as to be movable in a housing 10 counter to the action of a restoring spring 1. The housing 10 is in the form of a cylindrical sleeve and has, at its upper end, a recess 10.1 for receiving the lower end of the restoring spring 1 which is received, with its other end, in a recess 5.2 which is provided in a push-button cap 5.1 and thereby moves the push-button cap 5.1 or the push-button actuation element into the inactive position or initial position thereof. A torsion spring 11 is constructed at least partially as a sleeve which, on the one hand, is connected to a cylindrical journal 5.3 which is securely connected to the push-button actuation element 5.1 and, on the other hand, has resilient torsion spring elements 11.2. The torsion spring 11 and the tappet 13 may also be one part.

An air gap 4 is provided between the outer periphery of the push-button actuation element 5.1 and the inner periphery of the recess 10.1 so that a transmission of a sound signal, which is decoupled from or independent of a haptic signal, can be carried out via the air gap 4 if, for example, the tappet 13, as will be explained in greater detail below, is subjected to a hard impact or a security means. 12 against spring breakage, in this instance in the form of a stop, becomes active. Decoupling of the acoustics from the housing is thereby brought about.

Active sound generation is brought about by means of a piezoelectric actuator 15 which is provided in the lower actuation region of the tappet 13 at the inner wall of the housing 10. The active sound generation can further be brought about with a miniature loudspeaker. The sound emission is therefore carried out via the housing, with the push-button actuation element 5.1 not emitting any sound.

Figure 3:
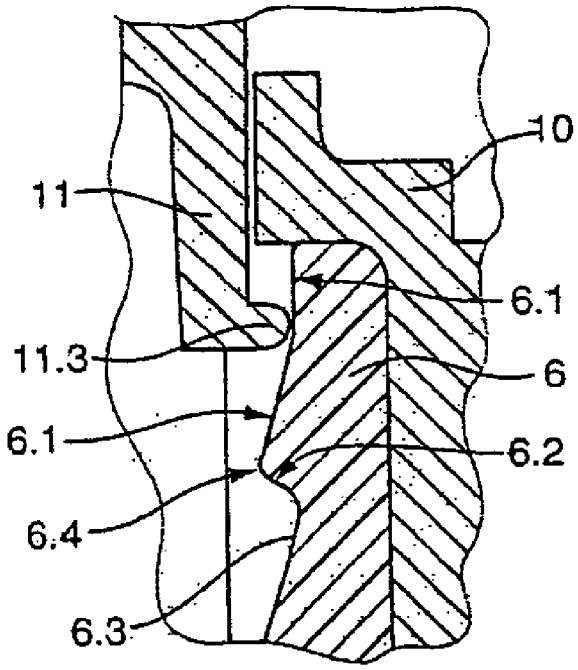
FIG. 3 is a partial section of an exchangeable contour module which has control face portions.

There is associated with the tappet 13 at least one actuation member 6 (also referred to below as a contour module) which triggers a haptic signal and which, as will be described in greater detail below, has a contour having control face portions 6.1, 6.2, 6.3 (FIG. 1 and FIG. 3) and a force transition location 6.4, along which a resilient actuation element 11 can be guided, and which co-operates with one or more permanent magnet(s) 3 which is/are provided in the lower region of the tappet 13. In the embodiment, two permanent magnets 3.1, 3.2 which are arranged one below the other are provided.

The resiliently constructed actuation member 11 can be guided along the guide contour of the actuation member 6 or the contour module by means of the push-button actuation element 5.1. The travel of the line path is also clear from FIG. 4. The line path is divided therein into three portions a, b, c which correspond to the control face portions 6.1 to 6.3 of the contour module 6.

The portion a is substantially larger than the portion b. A portion c which corresponds to the portion a adjoins the portion b. The greater the leading angle of the portion a is, the greater is also the actuation force which is intended to be applied to the switch and, consequently, the quality of the haptic response. By the push-button actuation element 5.1 being pressed, the operator obtains a clearly detectable, haptic response, which is acoustic by means of the piezoelectric actuator 15, concerning the position of the push-button 5. If a line point d which corresponds to a force transition is exceeded, the operator knows that he has triggered the switching-on function.

The guide contour which is provided in the housing 10 on the contour module 6 has the three control face portions 6.1, 6.2, 6.3. If the operator has brought about the force transition by exceeding the line maximum or, in accordance with FIG. 3, the force transition location 6.4 and has reached the line portion b, he holds the push-button actuation element 5.1 in that position for as long as the function corresponding to the switching position is desired. It is particularly advantageous if the restoring force of the restoring spring 1 is greater than the restoring force of the torsion spring 11 so that it is ensured that the switch or push-button 5 returns back to its initial position after the push-button actuation element 5.1 is released.

Figure 4:
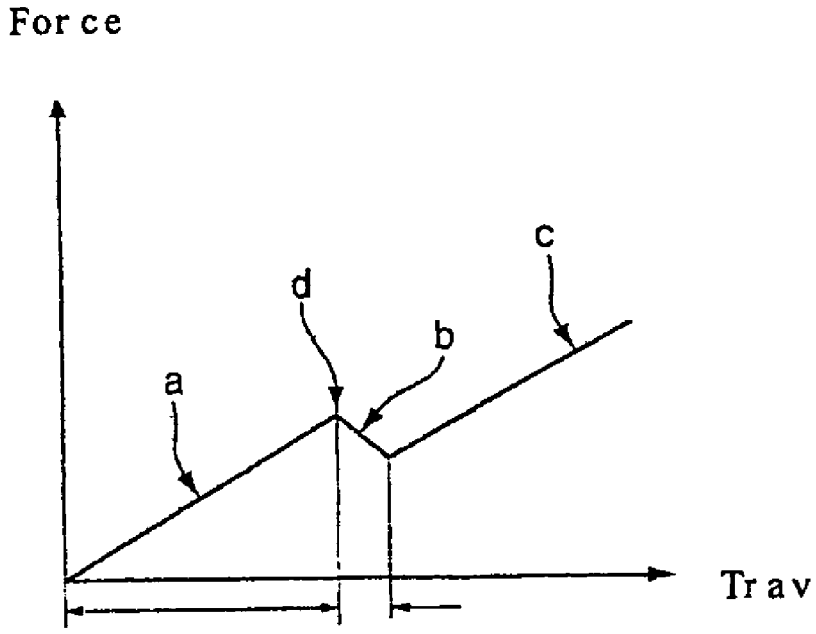
FIG. 4 is a graph with a force/travel characteristic of a resilient actuation member.

The optimally defined line path according to FIG. 4 forms the basis for establishing the contour of the contour module 6.

The electrical switching function is based on a plurality of principles. It is advantageous if the switch is configured so as to be redundant. Two Hall sensors 2 which are arranged opposite each other are used for this purpose, with only the rear Hall sensor 2 being partially visible in FIG. 1 and the front Hall sensor not being reproduced owing to the sectional illustration.

The permanent magnets 3.1, 3.2 which are arranged one below the other are guided past the Hall sensors 2 which are contained in a Hall sensor holder 7 and there is produced a Hall voltage 2.1 or 2.2. The Hall-effect sensor conducts the Hall voltage to a corresponding control device and thereby triggers a switching operation.

Figure 5:
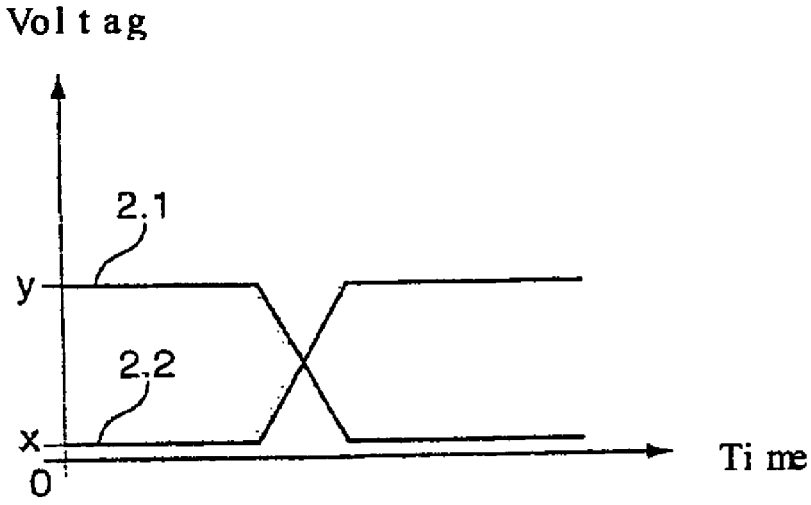
FIG. 5 is a graph with the voltage characteristics of two Hall sensors.

As is evident from FIG. 5, the Hall voltage 2.1 of one Hall sensor 2 decreases from a Y value to a zero value, whereas the Hall voltage 2.2 of the second Hall sensor increases from a value X to a value Y. If a Hall sensor fails in the event of a malfunction, the Hall sensor which has failed is immediately indicated by the different voltage path, without the switching function of the switch thereby being impaired.

The third actuation member 15 or the piezoelectric actuator for generating structure-borne noise on the sleeve is located in the lower region of the housing 10.

The electrical switching function and the haptic and acoustic response to the operator are separated from each other, as will be further explained below.

Therefore, if the tappet 13 is pushed downwards, the polarisation changes because an upper magnet 3.1 is switched to NS and a lower magnet 3.2 is switched to SN. If the tappet 13 is moved further downwards beyond the stop 12, the magnetic field changes again and the operator is made aware by means of the Hall sensors 2 that a permanent error has occurred so that the push-button must no longer be used, but instead must be changed. Owing to that arrangement, three signals or manipulated variables are produced, the inactive or zero position, the active position and the broken position of the push-button 5.

It is also possible for a plurality of actuation members or Hall sensors 2 to be provided in the housing 10 of the push-button 5. If additional sensors are fitted, the redundancy of the push-button 5 increases, as already mentioned.

It is further possible to construct the haptic actuation member 6, the torsion spring 11 which is fitted to a sleeve, the Hall sensor holder 7 and the security means 12 against spring breakage as individual structural members or as rotary members, and to fit them in the housing in such a manner that they can also be replaced at any time individually with larger or smaller structural members or rotary members which have different switching functions.

The acoustic decoupling between the housing 10 and the push-button cap 5.1 and the resilient torsion element 11 can be advantageously carried out in that different materials are used for those components so that different sound speeds are brought about. The decoupling is promoted by different factors of the materials and therefore the transition of the sound pulses between the structural elements is minimised.

The functions below of the push-button 5, that is to say, the electrical switching operation and haptic and acoustic response with respect to the operator, are separated from each other, as already mentioned. The advantageously constructed push-button 5 has a defined haptic response which is based on a force/travel target characteristic. To that end, the characteristic is divided, in accordance with FIG. 4, into a linear portion, line portion a, and a force transition, line portion d.

The haptic feedback is predetermined by a defined force/travel characteristic. In accordance with the desired characteristic, the haptic action can be adapted by the mechanism in the push-button. As already mentioned, the characteristic is divided into a linear portion and the force transition. Owing to that division, the parameters of the characteristic can be adjusted separately. The linear portion is brought about with a linearly resilient element, in this instance by the restoring spring 1. A resilient bar, a magnetic field, a silicone mat or a rubber member can also be used.

The force transition or tactile feedback is also brought about by the resilient element, in this instance by the torsion spring 11 of plastics material with a round head 11.3. The travel/force line which is brought about by the outer end or the round head 11.3 which is provided on the torsion spring 11 travelling along the outer contour of the first actuation member 6 is illustrated in a graph shown in FIG. 4. There can also be used a spring catch or a resilient disc or compression spring having a steel ball in the actuation element 11, which ball travels a defined contour according to the principle of a roller guide. In accordance with the contour of the actuation element 6 which triggers a haptic signal, the resilient actuation element or the torsion spring 11 is subjected to a force change, which constitutes the force transition or tactile feedback, by the torsion spring 11 travelling along the control face portion 6.1.

The actuation member 6 can have one or more control face portions 6.2 which extend in an inclined manner at an angle $\alpha$ relative to the centre plane of the tappet 13 and which can enclose an angle $\alpha$ of between 3° and 30° with the centre axis of the actuation member. An angled control face portion 6.3 adjoins the control face portions 6.2 of the first actuation member 6 and an engagement position is arranged between those portions 6.2. The size of the angle $\alpha$ between the two control face portions 6.2 and 6.3 can be between 90° and 130°. The line characteristic can be derived owing to the force/travel characteristic (FIG. 4) which is established theoretically. The angles are established therefrom. The angles can be adapted to the different requirements. To that end, the actuation member (FIG. 3) is in the form of an exchangeable contour module 6 so that, in accordance with requirements, the characteristic of the contour can be adapted or the contour module can be replaced by a differently constructed contour. To that end, it is simply necessary to remove the push-button actuation elements 7 and 8. Subsequently, the contour module 6 can be changed.

If the characteristics of the linear portion and the force transition are combined, a line addition is obtained, and therefore the desired force/travel target characteristic of the push-button 5.

The push-button 5 implements a defined and influencable haptic action as follows:

A defined force/travel characteristic is divided into the incline, that is to say, the linear portion or line portion a, and the force transition, line portion d. The linear portion is produced with the restoring spring 1 and the force transition is produced at the line portion d with the torsion spring 11 which is provided with the semi-circular head 11.3. The head 11.3 is guided along the outer contour of the contour module 6 which corresponds to the first actuation member and which results in a defined force change of the torsion spring 11. The force/travel characteristic of the restoring spring 1 added to the force/travel characteristic of the torsion spring 11 results in the entire force/travel characteristic of the push-button 5 in accordance with FIG. 4. The force transition can be corrected or changed by exchanging the torsion spring 11 and/or the contour module 6.

Figure 6:
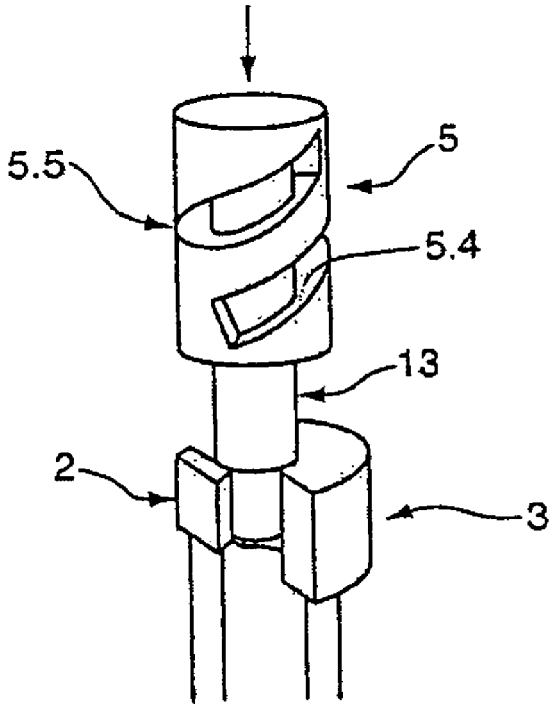
FIG. 6 is a view of part of another embodiment of a push-button with a rotatable push-button actuation element.

The implementation of the haptic action can be brought about according to FIG. 6 in rotary switches, for example, on a torque rotational angle characteristic which is not illustrated in the drawings. The linear portion is also produced with a spring in this instance. The contours necessary for the force transition or corresponding force transitions which are not illustrated here, illustrated similarly to those in FIG. 1 and FIG. 4, can be arranged in an annular manner in a spiral 5.4 which has an outer contour. A plurality of steps can be requested, and stepless linear operation is also possible. A tappet 5.5 can be guided along the outer contour of the spiral 5.4 and can bring about the switching functions described previously.

The acoustic action is decoupled from the housing 10 and transmission is carried out forwards or upwards only via the push-button cap 5.1 and the air gap 4. The sound signal can be triggered either by a hard impact against the tappet or by urging a resilient element.

Active sound generation can be brought about with the piezoelectric element 15 or by means of a miniature loudspeaker or by an electromagnetic coil. Alternatively, the transmission may be carried out via the housing, with the push-button cap 5.1 not emitting any sound.

The electrical switching operation is brought about in that two Hall sensors 2 are simultaneously subjected to a magnetic field change, with opposite polarity, by means of the two permanent magnets 3. The advantage involves the diversity, with the Hall sensors 2 emitting two opposing signals (FIG. 6). The failsafe nature of this redundant system is increased in that the same operating principle is implemented in two different manners. Whilst a Hall sensor 2 emits a high signal, the second sensor emits a low signal. As soon as a sensor fails, this is registered by an electronic evaluation unit. The connected electronic unit can change, for example, a machine to a controllable state and inform the operator about a failure. After one Hall sensor 2 has failed, it is also possible to operate the push-button 5 temporarily with only one Hall sensor.

The push-button 1 can be expanded by a plurality of switching steps with similar Hall sensors which are not illustrated here. Each switching step is associated with a specific Hall voltage range.

The structure can also be used in large travel ranges with two Hall sensors. In this instance, the translational pressure movement is converted into a rotational movement by means of the spindle construction (FIG. 6) which has already been mentioned but only part of which is illustrated in the drawing.

The switching operation may also be carried out by magnetostatic, magnetodynamic, magnetoresistive, inductive, LVDT, capacitive, optical, mechanical and pneumatic signal converters. An optical and pneumatic signal conversion is advantageous for compliance with EMC guidelines and for explosion protection. Electrical, pneumatic and optical types of signal can be used for the transmission. For example, quadratic encoders, resistance values, air pressure values are advantageous as evaluation principles for establishing the position and direction of movement. Analogue signals or incremental signals can be read out or evaluated.

A security means against spring breakage, which is formed by an abutment 12.1 provided on the tappet 13 and the stop 12 which is provided in the movement plane of the abutment 12.1, is intended to prevent the push-button actuation element 5.1 from being able to be further actuated after a spring breakage. If the operator actuates the push-button 5 again after a spring has broken, the tappet 13 breaks through the lower stop 12 so that the security means against spring breakage is triggered. The tappet 13 is held in the lower position by means of the abutment 12.1 and the lower stop 12 provided on the housing 10, which is perceived by the operator as an engaging sensation. In this instance, the tappet 13 triggers an electrical contact, which is detected by an external electronic evaluation unit as an error message, by means of a contact switch 14 which is arranged on a board 9 and which is arranged in the movement plane of the tappet 13. In place of the switch 14, it is also possible for the two signals of the Hall sensors 2 to be evaluated accordingly when the tappet 13 has passed the security means against spring breakage or the stop 12 and thereby signals the damaged position of the switch or push-button 5 to the operator.

The board 9 is received in a cover 8 which is connected to the housing 10. The cover 8 can be connected securely to the housing or connected to the housing 10 via a rotary securing means or snap-fit closure means. This has the advantage that the individual components, such as the actuation element 11, actuation member 6, Hall sensor holder 7 and tappet 13, can readily be pushed into the housing 10 through an opening 16 provided at the lower end of the housing 10.

What is claimed is:

1. Push-button comprising:

a housing with which there are associated at least a first actuation member which triggers a haptic control signal and one or more permanent magnet(s) which can be guided past at least a second actuation member which triggers a switching operation, which triggers a haptic response said first actuation member having one or more control face portion(s) extending in an inclined manner at an angle ($\alpha$) relative to a centre plane of the trigger and enclosing an angle of between 3° and 30° with the centre axis of the first actuation member in order to control the haptic signal, a control element having a first progressive or degressive control face portion and at least a second adjoining control face portion which acts in an inverse manner and along guidance of the actuation member; and an angled control face portion adjoining the second control face portion at an angle of between 77° and 130°.

2. Push-button according to claim 1, wherein there are associated with the first actuation member a resilient actuation element and control face portions which extend substantially in the movement direction of the push-button.

3. Push-button according to claim 1, wherein the first control face portion which covers a large travel path (a) extends in a substantially linearly ascending manner, the second control face portion which covers a small travel path (b), is adjacent thereto and at least one additional ascending third control face portion which covers a large travel path (c) is adjacent thereto.

4. Push-button according to claim 1, wherein there are associated with the push-button the first actuation member which triggers a haptic control signal, the second actuation member which triggers a switching operation and/or a third actuation member (acoustics) which triggers a sound pulse.

5. Push-button according to claim 4, wherein the first actuation member which triggers a haptic control signal and the other actuation members are decoupled from each other in terms of effect.

6. Push-button according to claim 1, wherein the switching operation which is triggered by one or more actuation member(s) is carried out by means of Hall sensors, light barriers, mechanical switching contacts or capacitive or inductive sensors.

7. Push-button according to claim 1, wherein the first actuation member is in the form of a torsion spring and can be guided along a guide contour which is provided in the housing and which forms the control face portions when the push-button or a push-button actuation element is moved in an axial direction.

8. Push-button according to claim 1, wherein a guide contour provided in the housing has one or more engagement position(s) which is/are each associated with a switching function.

9. Push-button according to claim 1, wherein the push-button has a tappet with which there is associated in the lower actuation region a security means against spring breakage which comprises a first abutment which is arranged on the tappet and a stop which is provided on the housing and which is in the movement plane of the abutment.

10. Push-button according to claim 1, wherein there is provided, in a lower region of the tappet a contact or an electrical connection against which the tappet can be moved directly or indirectly in the end position thereof for opening when it has passed a security means against spring breakage which is formed by the abutment and the stop.

11. Push-button according to claim 1, wherein a contact or contact switch with its contact element is in the movement plane of a tappet.

12. Push-button according to claim 1, wherein the abutment of a tappet has an abutment face which is moved into an abutment against an abutment face provided on the first actuation member in the initial position or inactive position of the push-button by means of a restoring spring.

13. Push-button according to claim 1, wherein the housing has, in the upper region, a recess for receiving the restoring spring which abuts, on the one hand, the push-button actuation element and, on the other hand, the housing.

14. Push-button according to claim 1, wherein a torsion spring is constructed at least partially as a sleeve which is connected, on the one hand, to a cylindrical journal which is securely connected to the push-button actuation element and which has, on the other hand, resilient torsion spring elements.

15. Push-button according to claim 1, wherein a torsion spring and a tappet are constructed in one piece.

16. Push-button according to claim 1, wherein an air gap is provided between the outer periphery of the push-button actuation element and the inner periphery of a recess.

17. Push-button according to claim 1, wherein the restoring force of a spring is greater than the restoring force of a torsion spring.

18. Push-button according to claim 1, wherein the haptically acting first actuation member which is associated with the push-button, the second actuation member which triggers a switching operation and the third actuation member (acoustics) which triggers a sound pulse are adjustable relative to each other.

19. Push-button according to claim 1, wherein the first actuation member is formed by a contour module and a torsion spring, and in that the actuation member which triggers a haptic control signal comprises a guide contour provided in the housing and the actuation element which co-operates therewith, which is in the form of a torsion spring and which can be guided along the guide contour of the actuation member by means of the push-button actuation element.

* * * * *